US010619393B2

(12) United States Patent
Albrecht

(10) Patent No.: US 10,619,393 B2
(45) Date of Patent: Apr. 14, 2020

(54) DEVICE FOR OPENING AND CLOSING A MOVABLE FURNITURE PART

(71) Applicant: Grass GmbH, Höchst (AT)

(72) Inventor: Markus Albrecht, Lustenau (AT)

(73) Assignee: Grass GmbH, Höchst (AT)

( * ) Notice: Subject to any disclaimer, the term of this patent is extended or adjusted under 35 U.S.C. 154(b) by 508 days.

(21) Appl. No.: 15/240,199

(22) Filed: Aug. 18, 2016

(65) Prior Publication Data

US 2017/0051547 A1 Feb. 23, 2017

(30) Foreign Application Priority Data

Aug. 21, 2015 (DE) ..... 20 2015 005 844 U

(51) Int. Cl.

*A47B 88/463* (2017.01)
*A47B 46/00* (2006.01)
*E05F 1/16* (2006.01)

(52) U.S. Cl.

CPC ..... *E05F 1/16* (2013.01); *A47B 46/005* (2013.01); *A47B 88/463* (2017.01); *E05Y 2201/22* (2013.01); *E05Y 2201/244* (2013.01); *E05Y 2201/426* (2013.01); *E05Y 2800/00* (2013.01); *E05Y 2900/20* (2013.01)

(58) Field of Classification Search

CPC . A47B 88/463; A47B 46/005; E05Y 2201/22; E05Y 2201/244; E05Y 2201/426; E05Y 2800/00; E05Y 2900/20; E05F 1/1246; E05F 1/1269; E05F 1/16; E05C 19/022

USPC ..... 74/469

See application file for complete search history.

(56) References Cited

U.S. PATENT DOCUMENTS

| | | | | |
|---|---|---|---|---|
| 7,887,147 | B2 * | 2/2011 | Karg | E05F 1/1066 312/319.2 |
| 2003/0117048 | A1 * | 6/2003 | Mueller | E05B 17/0037 312/330.1 |
| 2012/0161598 | A1 * | 6/2012 | Blum | E05F 1/1276 312/319.2 |
| 2014/0327351 | A1 * | 11/2014 | Chung | A47B 88/463 312/333 |
| 2015/0374125 | A1 * | 12/2015 | Goetz | A47B 88/463 312/319.1 |

FOREIGN PATENT DOCUMENTS

| | | | |
|---|---|---|---|
| DE | 10157754 | A1 | 6/2003 |
| DE | 202006020236 | U1 | 2/2008 |
| DE | 102010016608 | A1 | 10/2011 |
| DE | 202010009794 | U1 | 12/2011 |

* cited by examiner

*Primary Examiner* — Daniel J Troy
*Assistant Examiner* — Ryan A Doyle
(74) *Attorney, Agent, or Firm* — Edell, Shapiro & Finnan, LLC

(57) ABSTRACT

A device for opening and closing a movable furniture part such as a drawer, door or shutter, includes a push-out unit having at least one push-out element and a rechargeable energy storage element connected to the push-out element via a coupler, such that when the movable furniture part is pushed a specified or definable distance into the energy storage element, stored energy can be made available as kinetic energy in order to eject the movable furniture part. The coupler comprises a lever system with a plurality of levers connected to each other in an articulated manner via levers.

12 Claims, 4 Drawing Sheets

DEVICE FOR OPENING AND CLOSING A MOVABLE FURNITURE PART

CROSS REFERENCE TO RELATED APPLICATIONS

This application claims foreign priority under 35 U.S.C. § 119(a)-(d) to Application No. DE 202015005844.2 filed on Aug. 21, 2015, the entire contents of which are hereby incorporated by reference.

FIELD OF THE INVENTION

The invention relates to a device for opening and closing a movable furniture part, in particular a drawer, door or shutter, comprising a push-out unit, having at least one push-out element, and a rechargeable energy storage element connected to the push-out element via a coupler such that when the movable furniture part is pushed a specified or definable distance, energy stored in the energy storage element can be made available as kinetic energy in order to eject the movable furniture part.

BACKGROUND

A device of this kind is known from DE 20 2006 020 236 U1, for example. The device described in this document has a push-out unit which has an extension element and a locking unit with at least one locking element. The extension element is mounted on the drawer runner and cooperates with a limit stop arranged on the cabinet rail. The at least one locking element is screwed onto the cabinet body at an angle.

Moreover, it is known to provide movable furniture parts, for example drawers, with a so-called self-closing function, whereby the movable furniture part retracts into the closed position by itself and in a cushioned manner.

In movable furniture parts, for example, drawers, which are equipped with a push-out unit, the movable furniture part is pushed in a specified or definable distance and subsequently ejected using kinetic energy stored previously in an energy storage element. When the movable furniture part is retracted, the energy storage element is recharged.

SUMMARY

The object of the invention is to provide a device of the type referred to above, which makes it much easier, compared with conventional devices, for a user to initiate ejection and retraction of a movable furniture part as well as recharge the energy storage element.

The device according to the invention is characterized by the fact that the coupler comprises a lever system with a plurality of levers connected together in an articulated manner by way of hinges.

The lever system makes it possible to adjust the energy, in particular the forces for ejecting and charging the energy storage element and thus adapt to the user's requirements. It is possible, for example, to define the force, which needs to be exerted by the user upon retraction of the movable furniture part in order to charge the energy storage element, such that it is less than the force the user needs to apply for the short ejection stroke. This is possible by selecting suitable lever lengths and lever arms about defined pivot points of the lever system. This increases convenience for the user significantly.

In one embodiment of the invention, the push-out unit has locking mechanism, which holds the push-out element in a locked position and which can be released when the movable furniture part is pushed the specific or definable distance to initiate ejection.

In a particularly preferred embodiment, the locking mechanism is coupled to the push-out element and the energy storage element by way of the lever system. The lever system can thus transfer the actuation movement exerted on the push-out element to both the locking mechanism and the energy storage element. By selecting suitable lever lengths for the levers in the lever system, the forces transmitted to the locking mechanism and the energy storage element can be varied.

In a further embodiment of the invention, the locking mechanism has at least one locking element, which can be controlled via a controller such that when the movable furniture part is pushed in, the push-out element is released via forcible control exerted by the controller.

In a particularly preferred embodiment, the locking element is configured as a locking catch pivotably mounted about an axis of rotation. The controller can have a guideway for forcible control of the locking catch.

In a particularly preferred embodiment, the lever system is configured as a linkage mechanism, wherein preferably a four or seven hinge mechanism is provided. Four or seven hinge mechanisms form statically defined kinematic chains with a degree of flexibility, as a result of which a movement initiated on the kinematic chain inevitably leads to the movement of all the hinges or mechanism elements respectively.

In a further embodiment of the invention, the lever system has a base lever that can be pivoted about a fixed base hinge when tightening or ejecting the push-out element, to which the energy storage element is linked by way of a first hinge and the push-out element by way of a second hinge. The pivotable base lever can be configured in the manner of a floating lever, for example. It is advantageous if the levers in the lever system, i.e. also the base lever, are made of a flat material, for example, metal.

It is advantageous if the locking element is linked to the base lever by way of a third hinge.

In a particularly preferred embodiment, the distance between the base hinge and the first hinge is smaller than the distance between the base hinge and the second hinge.

In a further embodiment of the invention, the distance between the base hinge and the third hinge is greater than the distance between the base hinge and the second hinge.

The push-out element can be linked to the base lever in an articulated manner by way of a first connecting lever, wherein the first connecting lever is linked firstly to the base lever in an articulated manner by way of the second hinge, and secondly to the push-out element in an articulated manner by way of a fourth hinge.

Furthermore, the locking element, in particular the locking catch, can be arranged on the base lever in an articulated manner by way of a second connecting lever, wherein the second connecting lever is linked firstly to the base lever in an articulated manner by way of the third hinge, and secondly to the locking element in an articulated manner by way of a fifth hinge.

In a particularly preferred embodiment, the energy storage element is configured as a spring-type cylinder having at least one spring. It is advantageous if the spring-type cylinder is configured with a plurality of springs connected in parallel. A spring-type cylinder of this kind has the advantage that it is cost-efficient and easy to maintain. Furthermore, the ejection force acting on the movable furniture part on ejection can be varied by selecting different spring rigidities. The at least one spring of the spring-type cylinder can be configured as a tension spring, for example, which can be tightened by way of an actuation movement of the locking element when the movable furniture part is retracted, and linkage thereof by way of the lever system.

However, in principle other types of energy storage element could be used. For example, converting the kinematic energy available during retraction of the movable furniture part into electrical energy and storing it as such, wherein the electrical energy could then be converted back into kinetic energy during the ejection step, could be possible.

In a further embodiment of the invention, the at least one spring is arranged on a spring bracket and is fixed there between a first and a second supporting element arranged so as to be movable relative to each other. It is advantageous if the first supporting element is arranged on the base hinge in an articulated manner by way of the first hinge.

In a further embodiment of the invention, an actuation element for actuating the push-out element is provided such that the push-out element can be pushed by way of the lever system into releasing the locking element and the stored energy released from the energy storage element can eject the movable furniture part.

In a particularly preferred embodiment, the actuation element has a cam element, which can be brought into contact with the locking element when closing the movable furniture part, and said locking element moves into to the locked position whilst charging the energy storage element preferably tightening the at least one spring.

A mounting plate can be provided on which the energy storage element, push-out element, lever system and, where appropriate, locking element are arranged. Such a mounting plate provides a preassembled component, which can be fitted easily without the individual elements having to be fitted separately, possibly in cramped spaces.

In a further embodiment of the invention, a damping device is provided to cushion the retraction movement of the movable furniture part into the closed position.

The invention also relates to a furniture part, in particular a drawer, characterized by the aforementioned device.

The invention also includes a piece of furniture having a guiding device for guiding a movable furniture part and at least one movable furniture part characterized by the aforementioned device.

The mounting plate can be fitted onto the guiding device or the movable furniture part, for example, drawer, and correspondingly, the actuation element onto the movable furniture part or the guiding device.

BRIEF DESCRIPTION OF THE DRAWINGS

A preferred embodiment of the invention is shown in the drawings and explained in further detail below.

DETAILED DESCRIPTION

Figure 2:
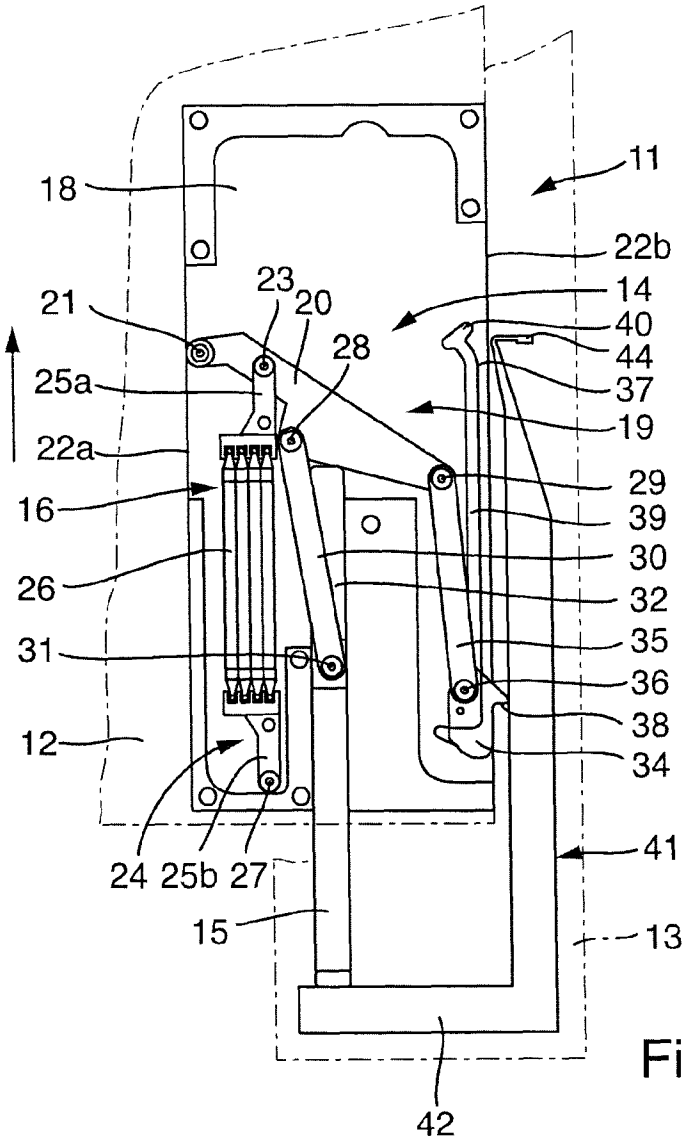
FIG. 2 shows a top view of the device in FIG. 1 after the movable furniture part has been ejected from the closed position.

FIGS. 1 to 6 show a preferred embodiment of the device according to the invention 11 for opening and closing a movable furniture part 12 (FIG. 2). The example here shows and describes the device 11 used in a movable furniture part 12 configured as a drawer. The device 11 can of course also be used on other movable furniture parts 12, for example on a door or shutter.

The drawer is movably mounted by means of a guiding device (not shown) relative to a cabinet body (not shown). The guiding device comprises a plurality of guide units (not shown), which are arranged on opposite sides of the drawer. The guide units each have a cabinet rail 13 (FIG. 2), which can be configured as a turned sheet metal device for example. The cabinet rail 13 is fixed in position using suitable fasteners on a designated side wall of a drawer compartment configured in the cabinet body. A central rail (not shown) is movably mounted on the cabinet rail 13 on which a pull-out rail (not shown) is movably guided by way of a bearing mechanism. The pull-out rail, which can also be called a sliding rail or runner, is assigned to the drawer and runs below the base of the drawer in a downwards direction. The combination of cabinet rail 13, central rail and pull-out rail is called the base unit. However, guide units without central rails can also be used.

The device also comprises a push-out unit 14, which has at least one push-out element 15, by means of which the drawer can be pushed in and then out a specified or definable distance.

A rechargeable energy storage element in the form of a spring-type cylinder 16 is assigned to the push-out element 15, which is coupled to the push-out element 15 such that when the drawer is pushed in the specified or definable distance, the energy stored in the energy storage element is made available as kinetic energy in order to push the drawer out.

In addition to the push-out element 15, the push-out unit 14 has a locking mechanism as a further main component, which holds the push-out element 15 in a locked position 17 and which can be released to initiate ejection when the movable furniture part is pushed in the specified distance.

Figure 1:
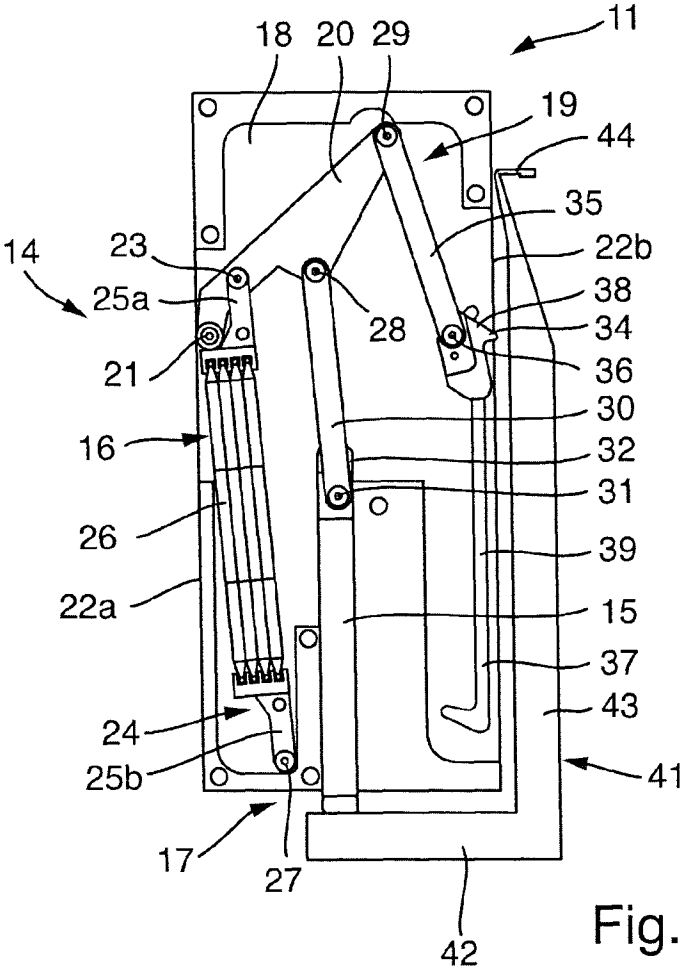
FIG. 1 shows a top view of a preferred embodiment of the device according to the invention for opening and closing a movable furniture part, wherein the furniture part is in the closed position.
Figure 3:
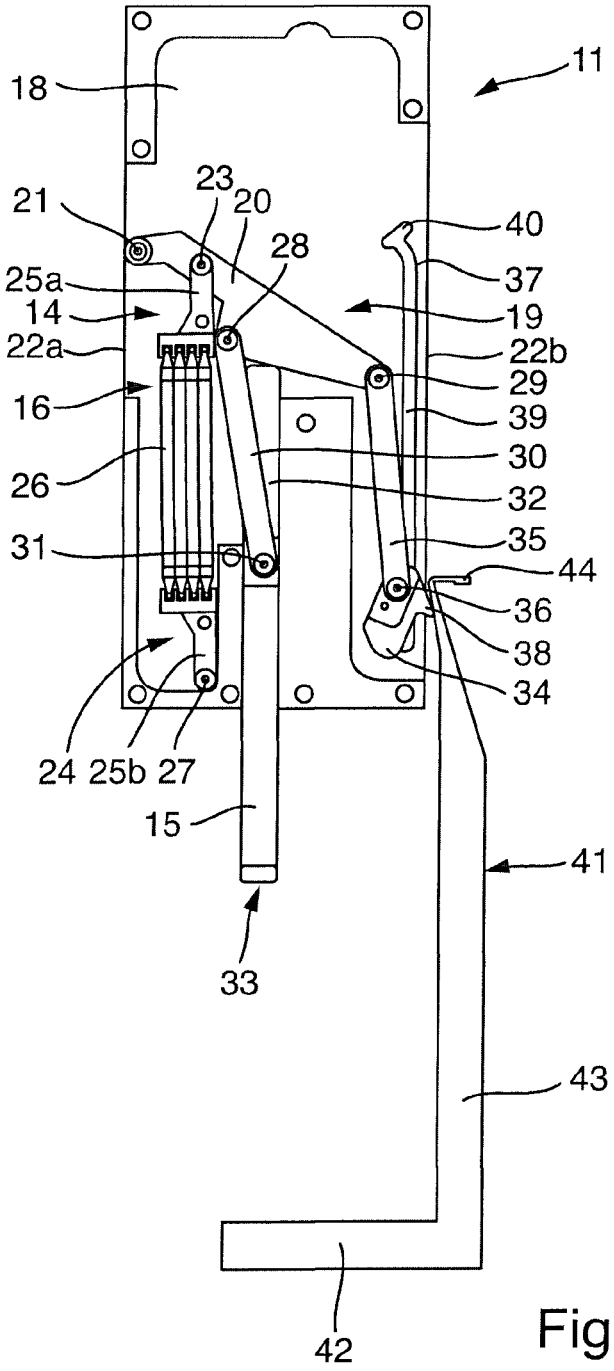
FIG. 3 shows a top view of the device in FIG. 1 wherein the movable furniture part has been moved out further.
Figure 4:
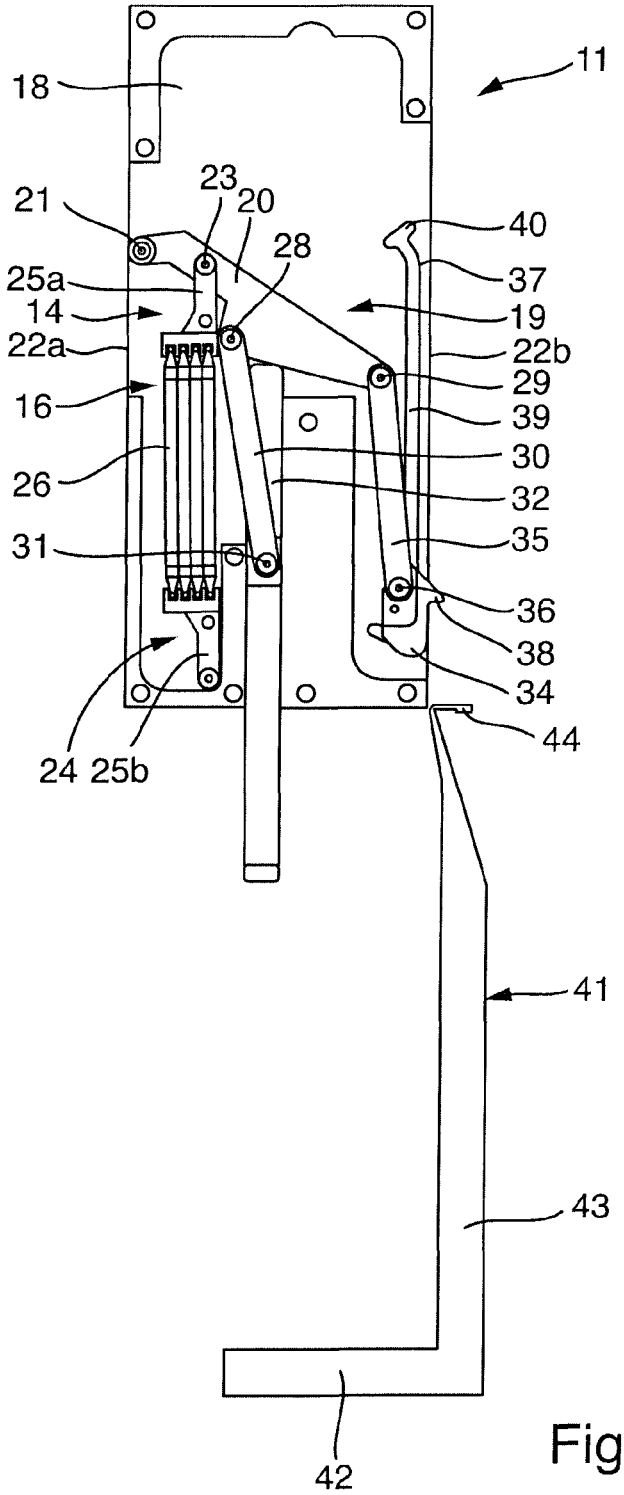
FIG. 4 shows a top view of the device in FIG. 1 in which the actuation element and the mounting plate are decoupled from the various components and the movable furniture part can be moved freely.

As shown particularly in FIG. 1, the three main components of the push-out unit 14, the push-out element 15, the spring-type cylinder 16 and the locking mechanism are mounted together on a mounting plate 18, which in turn is mounted on the drawer as per the preferred embodiment.

As also shown in FIG. 1, the three main components of the push-out unit 14, the push-out element 15, the spring-type cylinder 16 and the locking mechanism are connected to each other by way of the coupler. The coupler is configured as lever system 19, which comprises a plurality of levers connected to each other in an articulated manner by way of hinges.

The lever system 19 comprises a flat base lever 20, i.e. made of flat material, such as steel, in particular steel plate, which is pivotably mounted about a base hinge 21 that is immovable relative to the mounting plate 18. The base hinge 21 is located in the region of one of the long sides 22*a*, 22*b* of the mounting plate. The base lever 20 is configured as a floating lever and has further hinges for linking the aforementioned three main components of the push-out unit 14.

A first hinge 23 at a short distance from the base hinge 21 should be mentioned first, to which the spring-type cylinder 16 is linked.

The spring-type cylinder 16 has a spring bracket 24, which in turn has two supporting elements 25*a*, 25*b* movable relative to each other, between which at least one spring 26, in the example shown a plurality of springs 26 connected in parallel, is tightened. The springs 26 are configured as tension springs, which are tensioned away from each other when the supporting elements 25*a*, 25*b* move. The first supporting element 25*a* is mounted on the base lever 20 in an articulated manner by way of the first hinge 23. The second supporting element 25*b* on the other hand is mounted on the mounting plate 18 in an articulated manner by way of a further base hinge 27, which is also immovable relative to the mounting plate 18.

A second hinge 28 is located on the base lever 20, the distance of which from the base hinge 21 is greater than the distance between the first hinge 23 and the base hinge 21. The push-out element 15 is mounted on the second hinge 28 in an articulated manner.

Finally, a third hinge 29 is provided on the base lever 20, which is arranged on the other end of the base lever 20, i.e. on the end opposite the end provided with the base hinge 21. Consequently, the distance between the base hinge 21 and the third hinge 29 is greater than the distance between the first hinge 23 and the base hinge 21 and also greater than the distance between the second hinge 28 and the base hinge 21. Thus, a relatively larger lever arm making use of the entire length of the base lever is provided between the third hinge 29 and the base hinge 21.

Returning to the push-out element 15, this is, as shown particularly in FIG. 1, connected to the base lever 20 by way of a connecting lever 30. The connecting lever 30, which is also configured as a flat lever, is connected to the base lever 20 in an articulated manner by way of the second hinge 28 and to the push-out element 15 by way of a fourth hinge 31. The push-out element 15 is configured as a push rod, which is movably guided in a linear direction in a guide slot 32 configured in the mounting plate 18 in a longitudinal direction of the mounting plate 18. The rod-like push-out element 15 is therefore movably guided in a linear direction between the locked position 17 shown in FIG. 1 and an ejected position 33 shown in FIG. 3.

As shown particularly in FIG. 1, the locking mechanism has a locking element in the form of a locking catch 34. The locking catch 34 is connected to the base lever 20 by way of a further connecting lever 35. It is advantageous if the further connecting lever 35 is also configured as a flat lever. The further connecting lever 35 is firstly mounted on the base lever 20 in an articulated manner about the third hinge 29 and secondly, linked to the locking catch 34 by way of a fifth hinge 36. A controller is assigned to the locking catch 34, which, in the example shown, has a guideway 37 for forcible control of the locking catch 34. As shown, particularly in FIG. 2, the guideway 37, which is configured in an advantageous manner as a guide cushion in the mounting plate 18, extends in a longitudinal direction of the mounting plate 18. The locking catch 34 has a cam pin (not shown) on the underside thereof, which plunges into the guideway 37 and is forcibly guided there. The locking catch 34 also has a lug-like projection 38, which protrudes over the long edge of the mounting plate 18. The cushion-like guideway 37 has a guide region 39, which extends substantially parallel to the long edge of the mounting plate 18, onto which functional regions connect at each end. One of said functional regions is configured as a locking groove 40, which runs diagonal to the guide region 39 of the guideway 37, and rising in the direction of the long edge of the mounting plate 18. In the locked position 17 of the locking catch 34, the cam pin is positioned at the lowest position in the locking groove 40.

The device 11 also comprises an actuation element 41, which in the example shown is attached to the cabinet rail 13. The actuation element 41 is L-shaped in a longitudinal section with a short cross bar 42, which is assigned to the push-out element 15 and in the closed position of the drawer is attached to an impact section of the push-out element 15. A long bar 43 running substantially parallel to the long edge of the mounting plate 18 is also provided, which has a cam element 44 at the free end thereof, which interacts in a manner explained in greater detail below with the projection 38 on the locking catch 34.

As shown particularly in FIG. 1, the drawer and the mounting plate 18 with the push-out unit 14 attached to it are initially in the closed position. Here, the cross bar 42 of the actuation element 41 is in contact with an actuation section of the push-out element 15. The user now pushes the drawer a specified and predefined distance inwards into the closed position. In doing so, the distance between the transverse side of the mounting plate 18 and the cross bar 42 of the actuation element 41 is reduced and the rod-like push-out element 15 is drawn further into the guide slot 32. This actuation movement is transferred by way of the fourth hinge and the connecting lever 30 and the third hinge 29 to the base lever 20, which pivots arounds the base hinge 21 in an anti-clockwise direction. In the locked position 17, the tension springs are tight and the cam pin of the locking catch 34 is located in the locking groove 40. If the base lever 20 is now pivoted about the base hinge 21 in an anti-clockwise direction, the third hinge 29, which is also located on the base lever 20, is pivoted likewise. Linking the base lever 20 to the locking catch 34 by way of the further connecting lever 35 leads to the forcibly controlled outward displacement of the cam pin, which is in the locked position, into the locking groove 40 at an angle and this overrides locking.

Once locking has been overridden, the tension springs come into operation. A spring force of said tension springs is sought after in order to shorten the distance between both the supporting elements 25*a*, 25*b*. This leads to the spring force of the tension springs causing the base lever 20 to pivot about the base hinge 21 in a clockwise direction. The push-out element 15 is ejected from the guide slot 32 in the process by way of the linkage by way of the connecting lever 30. This results in the mounting plate 18 and the linked drawer being pushed away from the actuation element 41 and the drawer being pushed out.

The locking catch 34 is guided onto the straight-line guide region 39 in the process. As shown particularly in FIG. 3, the projection 38 of the locking catch 34 is moved past the fixed cam element 44. The cam element 44 pushes the locking catch 34 with the projection 38 aside whereby the locking catch 34 is pivoted about the fifth hinge 36 in a clockwise direction. A spring (not shown) ensures that the locking catch 34 with the projection 38 pivots back into its starting position once the cam element 44 has been passed. On retraction, the projection 38 strikes the cam element 44 again, as described below. As shown particularly in FIG. 3, the push-out element 15 is ejected to the point where the tension springs slacken off. The drawer can then be pulled out further separately from the actuation element 41.

Figure 5:
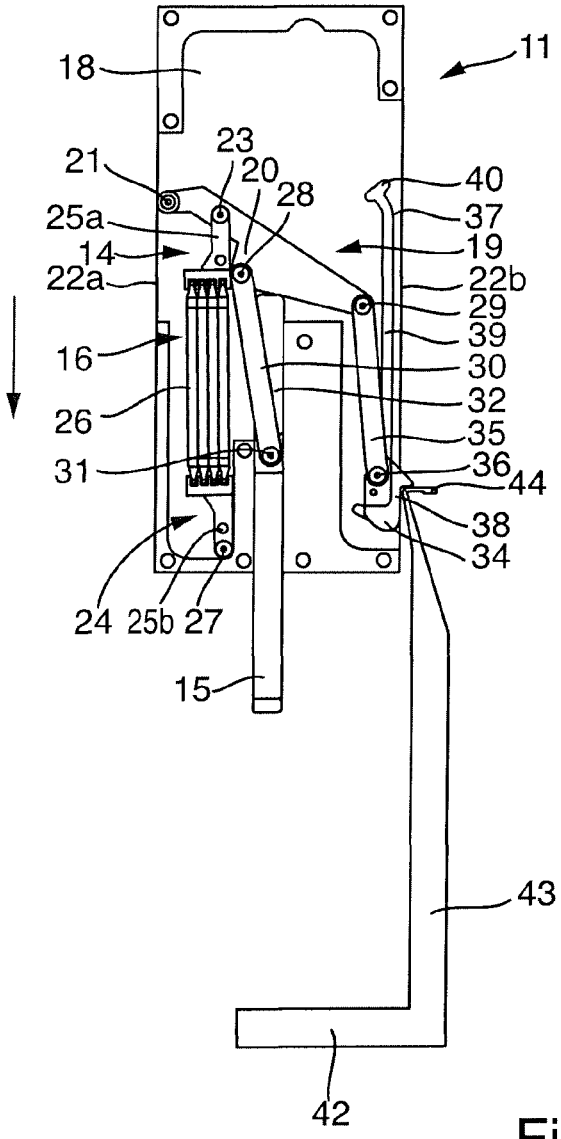
FIG. 5 shows a top view of the device in FIG. 1 during retraction of the movable furniture part, wherein the locking element comes into contact with the actuation element.
Figure 6:
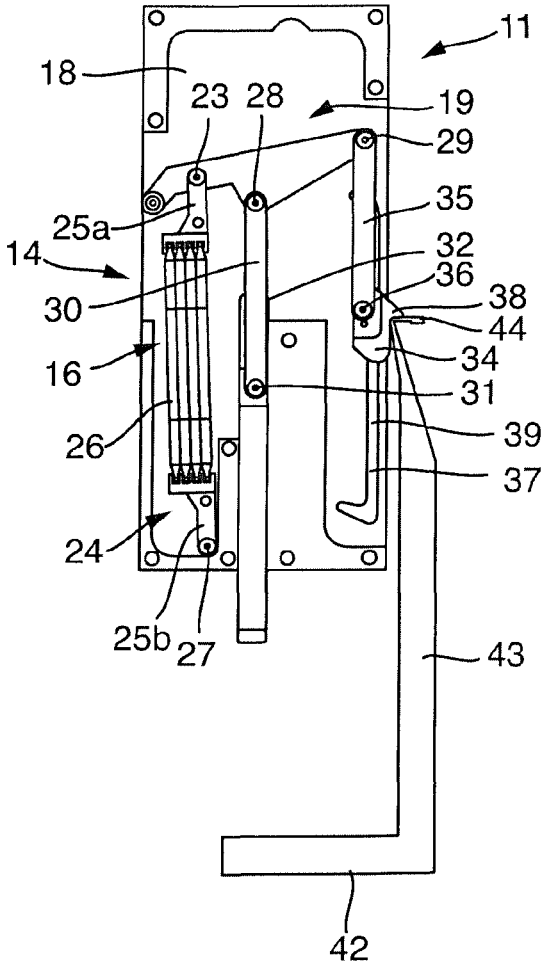
FIG. 6 shows a top view of the device in FIG. 1 in which the movable furniture part has retracted further, wherein the spring-type cylinder is tightened.

FIGS. 5 and 6 show the retraction of the drawer into the closed position. When closing the drawer, the projection 38 on the locking catch 34 comes into contact with the fixed cam element 44 on the actuation element 41, whereby the locking catch 34 is displaced in a linear manner into the guide region 39 in the direction of its locked position 17. This retraction movement causes a pivoting of the base lever 20 about the base hinge 21 in an anti-clockwise direction. The distance between both supporting elements 25*a*, 25*b* of the spring-type cylinder 16 is then increased and the tension springs are tightened. When the drawer retracts further, the cam pin of the locking catch 34 clicks into place in the locking groove 40, wherein the locking catch 34 is pivoted on the fifth hinge in an anti-clockwise direction and consequently the projection 38 is no longer in contact with the cam element 44 whereby projection 38 and cam element 44 can pass each other. From a specified retraction position, the cross bar 42 of the actuation element 41 comes into contact with the actuation section of the push-out element 15 again, whereby the position shown in FIG. 1 is reached. In this position, the tension springs of the spring-type cylinder are tight whereby the spring force thereof is available again for the subsequent ejection sequence.

It is characteristic that the distance between the first hinge 23, on which the spring-type cylinder 16 is linked to the base lever 20, and the base hinge 21 is shorter than the distance between the second hinge 28, to which the push-out element 15 is linked, and the base hinge 21. The distance between the third hinge 29, to which the locking catch 34 is coupled, and the base hinge 21 is the greatest. Therefore, on ejection, the relatively great tensile force of the tension springs acts on the base lever 20 by means of a small lever arm. The lever arm between the push-out element 15 and the base hinge 21 is, however, larger and consequently the tensile force of the springs is converted into a slightly smaller force for ejection purposes. However, a great advantage is the large lever arm between the third hinge 29 and the base hinge 21, whereby the tension springs can be tightened on retraction due to the large lever arm using relatively low force. The physical effort required by the user in order to tighten the tension springs is therefore kept to a minimum. The tension springs still make a greater force available on ejection which is then delivered by way of the push-out element 15 and ensures ejection of the drawer.

What is claimed is:

1. A device for opening and closing a movable furniture part that is a drawer, the device comprising:

a push-out unit; and a guideway, wherein the push-out unit includes a coupler, at least one push-out element, and a rechargeable energy storage element connected to the at least one push-out element via the coupler, such that when the movable furniture part is pushed a specified or definable distance, energy stored in the energy storage element becomes available as kinetic energy in order to eject the movable furniture part, wherein the coupler is configured as a lever system comprising a plurality of levers each having opposed ends, the opposed ends of each lever being pivotably connected in an articulated manner via multiple hinges, wherein the multiple hinges include a base hinge, a first hinge, a second hinge, and a third hinge, wherein the plurality of levers includes a base lever pivotable about the base hinge to which the energy storage element is linked via the first hinge and the at least one push-out element via the second hinge, wherein the push-out unit further includes a locking mechanism that holds the at least one push-out element in a locked position and that is releasable when the movable furniture part is pushed in the specified or definable distance to initiate ejection, wherein the locking mechanism is connected to the at least one push-out element and the energy storage element via the lever system, wherein the locking mechanism includes at least one locking element that is controllable by the guideway such that, when the movable furniture part is pushed in the specified or definable distance, the at least one locking element releases the at least one push-out element via forcible control exerted by the guideway, wherein the at least one locking element is configured as a locking catch pivotably mounted about an axis of rotation, and the guideway provides forcible control of the locking catch, and wherein the locking catch is linked to the base lever via the third hinge.

2. The device according to claim 1, wherein the lever system is configured as a four or seven hinge mechanism which includes the base hinge, the first hinge, the second hinge, and the third hinge.

3. The device according to claim 1, wherein the distance between the base hinge and the first hinge is shorter than the distance between the base hinge and the second hinge.

4. The device according to claim 1, wherein the distance between the base hinge and the third hinge is greater than the distance between the base hinge and the second hinge.

5. The device according to claim 1, wherein the plurality of levers further includes a first connecting lever and the multiple hinges further include a fourth hinge, wherein the at least one push-out element is linked to the base lever in an articulated manner via the first connecting lever, and wherein the first connecting lever is linked to the base lever in an articulated manner via the second hinge, and to the at least one push-out element in an articulated manner via the fourth hinge.

6. The device according to claim 5, wherein the plurality of levers further includes a second connecting lever and the multiple hinges further include a fifth hinge, wherein the locking catch is arranged on the base lever in an articulated manner via the second connecting lever, and wherein the second connecting lever is connected to the base lever in an articulated manner via the third hinge, and to the locking catch in an articulated manner via the fifth hinge.

7. The device according to claim 1, wherein the energy storage element is configured as a spring-type cylinder provided with at least one tension spring.

8. The device according to claim 7, wherein the at least one tension spring is arranged on a spring bracket between first and second supporting elements arranged movably relative to each other, wherein the first supporting element is arranged on the base lever in an articulated manner via the first hinge.

9. The device according to claim 7, further comprising an actuation element to actuate the at least one push-out element such that the at least one push-out element is configured to be pushed via the lever system into releasing the at least one locking element and the stored energy released from the energy storage element is capable of ejecting the movable furniture part.

10. The device according to claim 9, wherein the actuation element includes a cam element configured to be brought into contact with the at least one locking element when closing the movable furniture part, and the cam element moves into the locked position charging the energy storage element, tightening the at least one tension spring.

11. The device according to claim 1, further comprising a mounting plate on which the energy storage element, the at least one push-out element, and the lever system are arranged.

12. A drawer comprising the device of claim 1.

* * * * *